US010314338B2

(12) United States Patent
Hawes et al.

(10) Patent No.: US 10,314,338 B2
(45) Date of Patent: Jun. 11, 2019

(54) ELECTRONIC VAPING DEVICE

(71) Applicant: Altria Client Services LLC, Richmond, VA (US)

(72) Inventors: Eric Hawes, Richmond, VA (US); Traci Martin, Richmond, VA (US); Berina Yerkic-Husejnovic, Richmond, VA (US); George Stafford, Richmond, VA (US); Alistair Bramley, Richmond, VA (US); Nicolas Castro, Richmond, VA (US); Ali A. Rostami, Richmond, VA (US); Geoffrey Brandon Jordan, Midlothian, VA (US)

(73) Assignee: Altria Client Services LLC, Richmond, VA (US)

( * ) Notice: Subject to any disclaimer, the term of this patent is extended or adjusted under 35 U.S.C. 154(b) by 82 days.

(21) Appl. No.: 15/190,379

(22) Filed: Jun. 23, 2016

(65) Prior Publication Data

US 2016/0374394 A1 Dec. 29, 2016

Related U.S. Application Data

(60) Provisional application No. 62/184,325, filed on Jun. 25, 2015.

(51) Int. Cl.

| | |
|---|---|
| ***A24F 47/00*** | (2006.01) |
| ***A24F 1/32*** | (2006.01) |
| ***A24F 7/00*** | (2006.01) |

(52) U.S. Cl.

CPC ..... *A24F 47/008* (2013.01); *A24F 1/32* (2013.01); *A24F 7/00* (2013.01)

(58) Field of Classification Search

CPC ..... A24F 47/008; A61M 11/042

See application file for complete search history.

(56) References Cited

U.S. PATENT DOCUMENTS

| | | | |
|---|---|---|---|
| D142,842 | S | 11/1945 | Daze |
| D212,753 | S | 11/1968 | Tughan |
| 3,587,573 | A | 6/1971 | Flack |
| 3,720,235 | A | 3/1973 | Schrock |
| D229,725 | S | 12/1973 | Berger |
| D229,788 | S | 1/1974 | Berger |

(Continued)

FOREIGN PATENT DOCUMENTS

| | | |
|---|---|---|
| CN | 202890464 U | 4/2013 |
| WO | WO-2013089358 A1 | 6/2013 |

OTHER PUBLICATIONS

International Search Report PCT/ISA/220 for International Application No. PCT/US2016/038889 dated Sep. 21, 2016.

(Continued)

*Primary Examiner* — Tulsidas C Patel
*Assistant Examiner* — Marcus E Harcum
(74) *Attorney, Agent, or Firm* — Harness, Dickey & Pierce, P.L.C.

(57) ABSTRACT

A cartridge of an electronic Taping device includes a mouth-end insert. The mouth-end insert includes at least eight outlets configured to distribute vapor. The mouth-end insert has a surface area surrounding the outlets that is configured to absorb heat from the vapor and reduce a temperature of the vapor exiting the mouth-end insert via the outlets to a temperature ranging from about 60° C. to about 70° C.

23 Claims, 2 Drawing Sheets

(56) References Cited

U.S. PATENT DOCUMENTS

D229,789 S 1/1974 Berger
D229,790 S 1/1974 Berger
D254,930 S 5/1980 Mandon et al.
D254,931 S 5/1980 Mandon et al.
D267,121 S 11/1982 Min
4,429,703 A 2/1984 Haber
4,945,929 A 8/1990 Egilmex
5,042,510 A * 8/1991 Curtiss ..... A24F 47/002 131/270
5,095,921 A 3/1992 Losee et al.
5,179,966 A 1/1993 Losee et al.
5,269,327 A 12/1993 Counts et al.
D347,490 S 5/1994 Gee et al.
D375,159 S 10/1996 Johansson
D384,283 S 9/1997 Davies et al.
D404,459 S 1/1999 Furner et al.
D404,629 S 1/1999 Cooper
D405,220 S 2/1999 Dal Monte
6,081,950 A 5/2000 Carey et al.
6,231,336 B1 5/2001 Chen
6,357,448 B1 3/2002 Sinclair, Jr.
6,649,268 B1 11/2003 Komine et al.
D489,679 S 5/2004 Wong
D508,199 S 8/2005 Winig et al.
D534,682 S 1/2007 Malhi
D548,086 S 8/2007 Conway et al.
D550,378 S 9/2007 Adams et al.
D550,829 S 9/2007 Buthier et al.
D555,085 S 11/2007 Kim
D633,034 S 2/2011 Heine et al.
D641,464 S 7/2011 De Haan et al.
D644,375 S 8/2011 Zhou
8,002,897 B2 8/2011 Palfy et al.
D646,431 S 10/2011 Awty et al.
D662,257 S 6/2012 Alelov
D684,311 S 6/2013 Liu
D685,522 S 7/2013 Potter et al.
D686,717 S 7/2013 Mack
D688,415 S 8/2013 Kim
8,499,766 B1 8/2013 Newton
D691,765 S 10/2013 Tucker et al.
D691,766 S 10/2013 Tucker et al.
D692,612 S 10/2013 Lowenthal et al.
D692,613 S 10/2013 Morreale
D694,468 S 11/2013 Chen
D695,449 S 12/2013 Tucker et al.
D702,478 S 4/2014 Wai
8,707,965 B2 4/2014 Newton
8,833,364 B2 9/2014 Buchberger
8,881,737 B2 11/2014 Collett
8,888,311 B2 11/2014 Parsons
8,897,628 B2 11/2014 Conley et al.
8,939,943 B2 1/2015 Edwards et al.
D722,196 S 2/2015 Tucker et al.
D724,262 S 3/2015 Hearn et al.
D724,781 S 3/2015 Hearn et al.
D725,821 S 3/2015 Levin et al.
D727,564 S 4/2015 LaForge et al.
D727,565 S 4/2015 LaForge et al.
D728,154 S 4/2015 Lavanchy et al.
D729,439 S 5/2015 Scatterday
D730,571 S 5/2015 Chen
9,050,427 B2 6/2015 Harris et al.
D738,567 S 9/2015 Tucker et al.
D739,598 S 9/2015 Lavanchy et al.
D742,021 S 10/2015 Labuschagne et al.
D743,097 S 11/2015 Tucker et al.
D748,323 S 1/2016 Tucker et al.
D749,509 S 2/2016 Blau
2012/0053512 A1 3/2012 Muse
2013/0068239 A1 3/2013 Youn
2013/0087160 A1 4/2013 Gherghe
2013/0140200 A1 6/2013 Scatterday
2013/0167854 A1 7/2013 Shin
2013/0192615 A1* 8/2013 Tucker ..... H01C 17/00 131/328
2013/0192621 A1* 8/2013 Li ..... H01C 17/00 131/329
2013/0192623 A1* 8/2013 Tucker ..... H01C 17/00 131/329
2013/0213419 A1* 8/2013 Tucker ..... A24F 47/008 131/328
2013/0228190 A1 9/2013 Weiss et al.
2013/0298905 A1 11/2013 Levin et al.
2013/0312742 A1 11/2013 Monsees et al.
2013/0319440 A1 12/2013 Capuano
2013/0327345 A1 12/2013 Clarke
2013/0340775 A1 12/2013 Juster et al.
2014/0014124 A1 1/2014 Glasberg et al.
2014/0020693 A1 1/2014 Cochand et al.
2014/0034070 A1 2/2014 Schennum
2014/0053856 A1 2/2014 Liu
2014/0060554 A1 3/2014 Collett et al.
2014/0076310 A1 3/2014 Newton
2014/0174458 A1 6/2014 Katz
2014/0202477 A1 7/2014 Qi et al.
2014/0209105 A1 7/2014 Sears et al.
2014/0224267 A1 8/2014 Levitz et al.
2014/0261489 A1 9/2014 Cadieux et al.
2014/0261492 A1* 9/2014 Kane ..... A24F 47/008 131/328
2014/0270727 A1 9/2014 Ampolini et al.
2014/0283859 A1 9/2014 Minskoff et al.
2014/0318558 A1 10/2014 Liu
2014/0336565 A1 11/2014 Nichols
2014/0345632 A1 11/2014 Scatterday
2014/0345635 A1 11/2014 Rabinowitz et al.
2014/0355969 A1 12/2014 Stern
2014/0360516 A1 12/2014 Liu
2015/0020822 A1 1/2015 Janardhan et al.
2015/0027456 A1 1/2015 Janardhan et al.
2015/0027470 A1 1/2015 Kane et al.
2015/0059784 A1 3/2015 Liu
2015/0144148 A1 5/2015 Chen
2015/0150307 A1 6/2015 Liu
2015/0196059 A1 7/2015 Liu
2015/0208726 A1 7/2015 Liu
2015/0208729 A1* 7/2015 Monsees ..... A24F 47/008 131/329
2015/0245657 A1 9/2015 Memari et al.
2015/0296889 A1 10/2015 Liu
2015/0328415 A1 11/2015 Minskoff et al.
2015/0332379 A1 11/2015 Alarcon
2016/0120228 A1* 5/2016 Rostami ..... A24F 47/008 131/329

OTHER PUBLICATIONS

International Preliminary Report on Patentability dated Jan. 4, 2018 for International Application No. PCT/US2016/03889 issued.
Mouthpiece of Smoking Article | Nikotek 3pk Cartridge | Metro, post date N/A, @ 2015 metroecigs.com, [online], [site visited Nov. 24, 2015], Available from Internet, http://www.metroecigs.com/product/metromentholnonlcotinecartridges.asp.
Mouthpiece of Smoking Article | V2 Cigs Blue | Ecigarette Reviewed | post date Mar. 24, 2014 @ 2015 ecigarettereviewed.com, [online], [site visited Nov. 24, 2015] Available from Internet, http://ecigarettereviewed.com/blu-cigs-review/.
"Smokio: Smart Wireless E-cigarette," http://www.premium lifestyle.com.uk/products/smokio-smart-wireless-e-cigarette.
About Electronic Cigarettes/ Vapor Cigarettes/E-cigs https://www.vapInapes.com/about-vapor-cigarettes/.
Supersmoke: The Latest Supersmoker Bluetooth, http://www.supersmokerbluetooth.com/.
Kosmo, https://www.indiegogo.com.com/projects/kosmo-ecigarette.
<http://www.kelvin.en.made-in-china.com/productimage/FghEJNdCeOVw-2f1l00KeBtCALgEiYE/China-High-Quality-

(56) References Cited

OTHER PUBLICATIONS

Triangular-Trimark-E-Cigarette.html> copyright 2015, Focus Technology Co., Ltd.

* cited by examiner

ELECTRONIC VAPING DEVICE

CROSS-REFERENCE TO RELATED APPLICATIONS

This non-provisional patent application claims priority under 35 U.S.C. § 119(e) to provisional U.S. application no. 62/184,325 filed on Jun. 25, 2015 in the United States Patent and Trademark Office, the entire contents of which are incorporated herein, by reference.

BACKGROUND

Field

The present disclosure relates to an electronic vaping or e-vaping device configured to deliver a pre-vapor formulation to a vaporizer.

Description of Related Art

An e-vaping device may include a heating element which vaporizes a pre-vapor formulation to produce a "vapor." The heating element may include a resistive heater coil, with a wick extending there through.

The e-vaping device includes a power supply, such as a battery, arranged in the device. The battery is electrically connected to the heater, such that the heater heats to a temperature sufficient to convert a pre-vapor formulation to a vapor. The vapor exits the e-vaping device through an outlet.

SUMMARY

At least one example embodiment relates to a cartridge of an electronic vaping device.

In at least one example embodiment, a cartridge of an electronic vaping device includes a mouth-end insert. The mouth-end insert includes at least eight outlets configured to distribute vapor. The mouth-end insert has a surface area surrounding the outlets that is configured to absorb heat from the vapor and reduce a temperature of the vapor exiting the mouth-end insert via the outlets to a temperature ranging from about 60° C. to about 70° C.

In some example embodiments, the temperature of the vapor exiting the outlets ranges from about 62° C. to about 66° C.

In at least one example embodiment, each of the outlets is angled at about 5° to about 60° in relation to a longitudinal axis of the cartridge. In other example embodiments, each of the outlets is angled at about 40° to about 50° in relation to the longitudinal axis of the cartridge.

In some example embodiments, the cartridge may also include an. outer housing extending in a longitudinal direction, the mouth-end insert affixed within an end of the outer housing, an inner tube within the outer housing, a reservoir containing a pre-vapor formulation, the reservoir contained in an outer annulus between the outer housing and the inner tube, a heater in the inner tube and a wick in fluid communication with the pre-vapor formulation and the heater, such that the wick delivers the pre-vapor formulation to the heater.

In at least one example embodiment, each of the outlets has a diameter ranging from about 0.015 inch to about 0.090 inch. In some embodiments, four of the outlets are larger than a remaining four outlets.

In another example embodiment, the outlets are generally tear drop in shape.

In an example embodiment, the eight outlets have a combined. outlet area of about 12 $mm^2$ to about 14 $mm^2$. A ratio of the combined outlet area to an area of the mouth-end insert ranges from about 1:3 to about 1:6. In some example embodiments, the ratio of the combined outlet area to an area of the mouth-end insert ranges from about 1:4 to about 1:5.

In at least one example embodiment, the mouth-end insert has a generally cylindrical side wall and a round downstream surface. The downstream surface of the mouth-end insert has a diameter ranging from about 8.5 mm to about 10.0 mm. The diameter of the downstream surface of the mouth-end insert may range from about 9.0 mm to about 9.5 mm. The downstream surface of the mouth-end insert may have a beveled edge. A circumference of the side wall is less than the diameter of the downstream surface of the mouth-end insert. The side wall has a length ranging from about 3 mm to about 5 mm. The side wall has a beveled, upstream edge.

In some example embodiments, the outlets are configured to produce an average exit velocity ranging from about 1.0 m/s to about 1.2 m/s. In at least one example embodiment, the outlets are configured to produce a maximum exit velocity ranging from about 2.0 m/s to about 2.2 m/ s.

In at least one example embodiment, the mouth-end insert is formed of high density polyethylene.

In another example embodiment, a cartridge of an electronic vaping device comprises a mouth-end insert. The mouth-end insert comprises eight outlets configured to distribute vapor. The eight outlets have a combined outlet area of about 12 $mm^2$ to about 14 $mm^2$, such that a ratio of the combined outlet area to an area of the mouth-end insert ranges from about 1:3 to about 1:6.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit it the scope of the claims. The accompanying drawings are not to be considered as drawn to scale unless explicitly noted. For purposes of clarity, various dimensions of the drawings may have been exaggerated.

DETAILED DESCRIPTION OF EXAMPLE EMBODIMENTS

Figure 1:
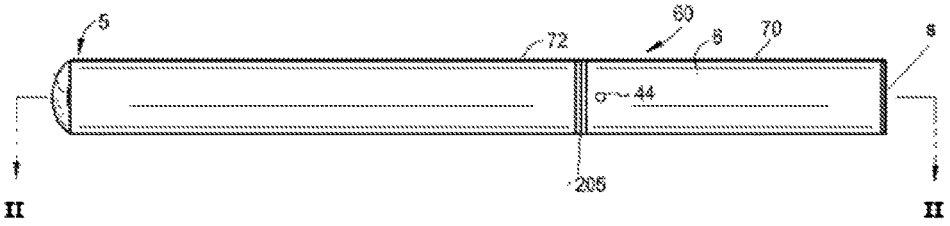
FIG. 1 is a side view of an e-vaping device according to an example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, components, regions, layers and/or sections, these elements, components, regions, layers, and/or sections should riot be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a " "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Figure 2:
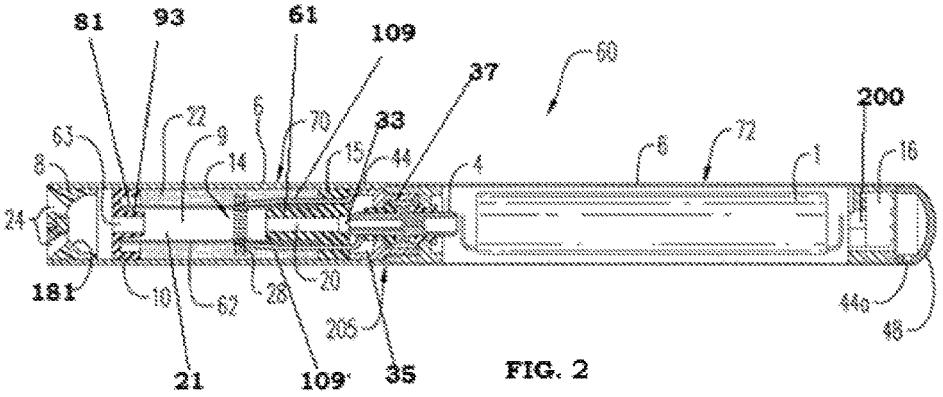
FIG. 2 is a cross-sectional view along line II-II of the e-vaping device of FIG. 1.
Figure 3:
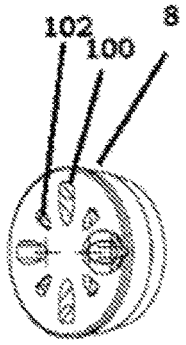
FIG. 3 is a perspective view of a mouth-end insert according to at least one example embodiment.
Figure 5:
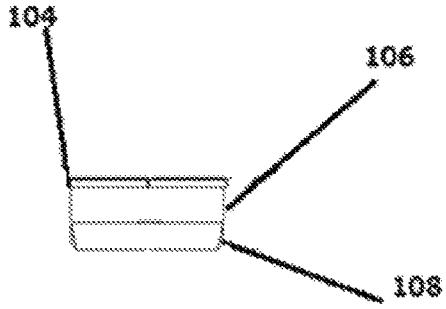
FIG. 5 is a side view of a mouth-end insert according to at least one example embodiment.
Figure 4:
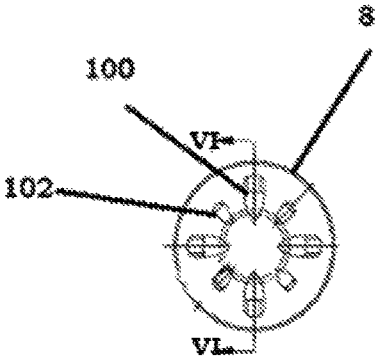
FIG. 4 is a top view of a mouth-end insert according to at least one example embodiment.
Figure 6:
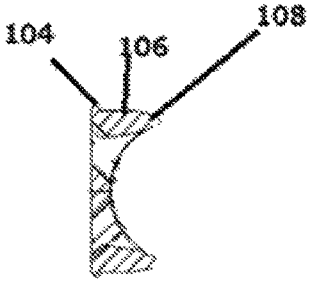
FIG. 6 is a cross-sectional view of a mouth-end insert along line VI-VI of FIG. 4 according to at least one example embodiment.

Referring to FIGS. 1-2, an e-vaping device 60 may include a replaceable cartridge (or first section) 70 and a reusable battery section (or second section) 72, which may be coupled together at a threaded connector 205. It should be appreciated that the connector 205 may be any type of connector, such as a snug-fit, detent, clamp, bayonet, and/or clasp. The second section 72 may include a sensor 16 responsive to air drawn into the second section 72 via an air inlet port 44*a* adjacent a free end or tip of the e-vaping device 60, a battery 1, and a control circuitry 200. The first section 70 may include a reservoir 22 for a pre-vapor formulation and a heater 14 that may vaporize the pre-vapor formulation, which may be drawn from the reservoir 22 by a wick 28. The e-vaping device 60 may include the features set forth in U.S. Patent Application Publication No. 2013/0192623 to Tucker et al. filed Jan. 31, 2013, the entire contents of which is incorporated herein by reference thereto.

The pre-vapor formulation is a material or combination of materials that may be transformed into a vapor. For example, the pre-vapor formulation may be a liquid, solid and/or gel formulation including, but not limited to, water, beads, solvents, active ingredients, ethanol, plant extracts, natural or artificial flavors, and/or vapor formers such as glycerin and propylene glycol.

Upon completing the connection between the first section 70 and the second section 72, the battery 1 may be electrically connectable with the heater 14 of the first section 70 upon actuation of the sensor 16. Air is drawn primarily into the first section 70 through one or more air inlets 44, which may be located along the housing or at the connector 205.

The first section 70 may include an outer housing 6 extending in a longitudinal direction and an inner tube (or chimney) 62 coaxially positioned within the outer housing 6.

The outer housing 6 may have a generally cylindrical cross-section. In other example embodiments, the outer housing 6 may have a generally triangular cross-section along one or more of the first section 70 and the battery section 72. In some example embodiments, the housing 6 may have a greater circumference or dimensions at a tip end than at a mouth-end of the e-vaping device 60.

At an upstream end portion of the inner tube 62, a nose portion 61 of a gasket (or seal) 15 may be fitted into the inner tube 62, while at the other end, an outer perimeter of the gasket 15 may provide a seal with an interior surface of the outer housing 6. The gasket 15 may also include a central, longitudinal air passage 20, which opens into an interior of the inner tube 62 that defines a central channel 21. A transverse channel 33 at a backside portion of the gasket 15 may intersect and communicate with the air passage 20 of the gasket 15. This transverse channel 33 assures communication between the air passage 20 and a space 35 defined between the gasket 15 and a cathode connector piece 37.

The cathode connector piece 37 may include a threaded section for effecting the connection between the first section 70 and the battery section 72.

It should be appreciated that more than two air inlet ports 44 may be included in the outer housing 6. Alternatively, a single air inlet port 44 may be included in the outer housing 6. Such arrangement allows for placement of the air inlet ports 44 close to the connector 205 without occlusion by the presence of the cathode connector piece 37. This arrangement may also reinforce the area of air inlet ports 44 to facilitate precise drilling of the air inlet ports 44. In some example embodiments, the air inlet ports 44 may be provided in the connector 205.

Referring back to FIG. 2, in at least one example embodiment, at least one air inlet port 44 may be formed in the outer housing 6, adjacent the connector 205 to minimize the chance of an adult vaper's fingers occluding one of the ports and to control the resistance-to-draw (RTD) during vaping. In an example embodiment, the air inlet ports 44 may be machined into the housing 6 with precision tooling g such that their diameters are closely controlled and replicated from one e-vaping device 60 to the next during manufacture.

In at least one example embodiment, t, the air inlet ports 44 may be drilled with carbide drill bits or other high-precision tools and/or techniques. In yet a further example embodiment, the outer housing 6 may be formed of metal or metal alloys such that the size and shape of the air inlet ports 44 may not be altered during manufacturing operations, packaging, and vaping. Thus, the air inlet ports 44 may provide consistent RTD. In yet a further example embodiment, the air inlet ports 44 may be sized and configured such that the e-vaping device 60 has a RTD in the range of from about 60 mm $H_2O$ to about 150 mm $H_2O$.

In some example embodiments, nose portion 93 of a downstream gasket 10 may be fitted into a downstream end portion 81 of the inner tube 62. An outer perimeter of the gasket 10 may provide a substantially tight seal with an interior surface 97 of the outer housing 6. The downstream gasket 10 may include a central channel 63 disposed between the inner passage 21 of the inner tube 62 and the interior of a mouth-end insert 8, which may transport the vapor from the inner passage 21 to the mouth-end insert 8.

The space defined between the gaskets 10 and 15 and the outer housing 6 and the inner tube 62 may establish the confines of a reservoir 22. The reservoir 22 may include a pre-vapor formulation, and optionally a storage medium (not shown) configured to store the pre-vapor formulation therein. The storage medium may include a winding of cotton gauze or other fibrous material about the inner tube 62.

The reservoir 22 may be contained in an outer annulus between the inner tube 62 and the outer housing 6 and between the gaskets 10 and 15. Thus, the reservoir 22 may at least partially surround the central inner passage 21. The heater 14 may extend transversely across the inner passage between opposing portions of the reservoir 22. In some example embodiments, the heater 14 may extend parallel to a longitudinal axis of the inner passage 21.

The reservoir 22 may be sized and configured to hold enough pre-vapor formulation such that the e-vaping device 60 may be configured for vaping for at least about 200 seconds. Moreover, the e-vaping device 60 may be configured to allow each vape to last a maximum of about 5 seconds.

The storage medium may be a fibrous material including at least one of cotton, polyethylene, polyester, rayon and combinations thereof. The fibers may have a diameter ranging in size from about 6 microns to about 15 microns (e.g., about 8 microns to about 12 microns or about 9 microns to about 11 microns). The storage medium may be a sintered, porous or foamed material. Also, the fibers may be sized to be irrespirable and may have a cross-section which has a Y-shape, cross shape, clover shape or any other suitable shape. In an alternative example embodiment, the reservoir 22 may include a filled tank lacking any storage medium and containing only pre-vapor formulation.

During vaping, pre-vapor formulation may be transferred from the reservoir 22 and/or storage medium in the proximity of the heater 14 via capillary action of the wick 28. The wick 28 may include a first end portion and a second end portion, which may extend into opposite sides of the reservoir 22. The heater 14 may at least partially surround a central portion of the wick 28 such that when the heater 14 is activated, the pre-vapor formulation in the central portion of the wick 28 may be vaporized by the heater 14 to form a vapor.

The wick 28 may include filaments (or threads) having a capacity to draw the pre-vapor formulation. For example, the wick 28 may be a bundle of glass (or ceramic) filaments, a bundle including a group of windings of glass filaments, etc., all of which arrangements may draw pre-vapor formulation via capillary action by interstitial spacings between the filaments. The filaments may be generally aligned in a direction perpendicular (transverse) to the longitudinal direction of the e-vaping device 60. In an example embodiment, the wick 28 may include one to eight filament strands, each strand comprising a plurality of glass filaments twisted together. The end portions of the wick 28 may be flexible and foldable into the confines of the reservoir 22. The filaments may have a cross-section that is generally cross-shaped, clover-shaped, Y-shaped, or in any other suitable shape.

The wick 28 may include any suitable material or combination of materials. Examples of suitable materials may be, but not limited to, glass, ceramic- or graphite-based materials. The wick 28 may have any suitable capillarity drawing action to accommodate pre-vapor formulations having different physical properties such as density, viscosity, surface tension and vapor pressure.

In at least one example embodiment, the heater 14 may include a wire coil which at least partially surrounds the wick 28. The wire may be a metal wire and/or the heater coil may extend fully or partially along the length of the wick 28. The heater coil may further extend fully or partially around the circumference of the wick 28. In some example embodiments, the heater coil 14 may or may not be in contact with the wick 28.

The heater coil may be formed of any suitable electrically resistive materials. Examples of suitable electrically resistive materials may include, but not limited to, titanium, zirconium, tantalum and metals from the platinum group. Examples of suitable metal alloys include, but not limited to, stainless steel, nickel, cobalt, chromium, aluminum-titanium-zirconium, hafnium, niobium, molybdenum, tantalum, tungsten, tin, gallium, manganese and iron-containing alloys, and super-alloys based on nickel, iron, cobalt, stainless steel. For example, the heater 14 may be formed of nickel aluminide, a material with a layer of alumina on the surface, iron aluminide and other composite materials, the electrically resistive material may optionally be embedded in, encapsulated or coated with an insulating material or vice-versa, depending on the kinetics of energy transfer and the external physicochemical properties required. The heater 14 may include at least one material selected from the group consisting of stainless steel, copper, copper alloys, nickel-chromium alloys, super alloys and combinations thereof. In an example embodiment, the heater 14 may be formed of nickel-chromium alloys or iron-chromium alloys. In another example embodiment, the heater 14 may be a ceramic heater having an electrically resistive layer on an outside surface thereof.

The heater 14 may heat pre-vapor formulation in the wick 28 by thermal conduction. Alternatively, heat from the heater 14 may be conducted to the pre-vapor formulation by means of a heat conductive element or the heater 14 may transfer heat to the incoming ambient air that is drawn through the e-vaping device 60 during vaping, which in turn heats the pre-vapor formulation by convection.

It should be appreciated that, instead of using a wick 28, the heater 14 may be a porous material which incorporates a resistance heater formed of a material having a high electrical resistance capable of generating heat quickly.

The power supply 1 may include a battery arranged in the e-vaping device 60. The power supply 1 may be a Lithium-ion battery or one of its variants, for example a Lithium-ion polymer battery. Alternatively, the power supply 1 may be a nickel-metal hydride battery, a nickel cadmium battery, a lithium-manganese battery, a lithium-cobalt battery or a fuel cell. The e-vaping device 60 may be usable by an adult vaper until the energy in the power supply 1 is depleted or in the case of lithium polymer battery, a minimum voltage cut-off level is achieved.

Further, the power supply 1 may be rechargeable and may include circuitry configured to allow the battery to be chargeable by an external charging device. To recharge the e-vaping device 60, an USB charger or other suitable charger assembly may be used.

Furthermore, the e-vaping device 60 may include the control circuit 200 and the sensor 16. The sensor 16 may be configured to sense an air pressure drop and initiate application of voltage from the power supply 1 to the heater 14. The control circuit 200 may also include a heater activation light 48 configured to glow when the heater 14 is activated. The heater activation light 48 may include an LED and may be at an upstream end of the e-vaping device 60. Moreover, the heater activation light 48 may be arranged to be visible to an adult vaper during vaping. In addition, the heater activation light 48 may be utilized for e-vaping system diagnostics or to indicate that recharging is in progress. The heater activation light 48 may also be configured such that the adult vaper may activate and/or deactivate the heater activation light 48 for privacy. The heater activation light 48 may be on a tip end of the e-vaping device 60 or on a side of the housing 6.

In addition, the at least one air inlet 44*a* may be located adjacent the sensor 16, such that the sensor 16 may sense air flow and activate the power supply 1 and the heater activation light 48 to indicate that the heater 14 is working. As shown in FIGS. 1 and 2, the heater activation light 48 may be located on the tip end of the e-vaping device. In other example embodiments, the heater activation light 48 may be located on a side portion of the housing 6.

Further, the control circuit 200 may supply power to the heater 14 responsive to the sensor 16. In one example embodiment, the control circuit may include a maximum, time-period limiter. In another example embodiment, the control circuit 200 may include a manually operable switch. The time-period of the electric current supply to the heater 14 may be pre-set depending on the amount of pre-vapor formulation desired to be vaporized. In yet another example embodiment, the circuitry may supply power to the heater 14 as long as the sensor 16 detects a pressure drop.

When activated, the heater 14 may heat a portion of the wick 28 surrounded by the heater for less than about 10 seconds. Thus, the power cycle (or maximum heating cycle length) may range in period from about 2 seconds to about 10 seconds (e.g., about 3 seconds to about 9 seconds, about 4 seconds to about 8 seconds or about 5 seconds to about 7 seconds).

The inner tube 62 may include a pair of opposing slots, such that the wick 28 and the leading end 109, 109' of the heater 14 may extend out from the respective opposing slots. The provision of the opposing slots in the inner tube 62 may facilitate placement of the heater 14 and wick 28 into position within the inner tube 62 without impacting edges of the slots and the coiled section of the heater 14. Accordingly, edges of the slots may not be allowed to impact and alter the coil spacing of the heater 14, which would otherwise create potential sources of hotspots.

In an example embodiment, the inner tube 62 may have a diameter of about 4 mm and each of the opposing slots may have major and minor dimensions of about 2 mm by about 4 mm.

In an example embodiment, the first section 70 may be replaceable. In other words, once the pre-vapor formulation of the cartridge is depleted, only the first section 70 may be replaced. An alternate ate arrangement may include an example embodiment where the entire e-vaping device 60 may be disposed once the reservoir 22 is depleted.

In an example embodiment, the e-vaping device 60 may be about 80 mm to about 110 mm long and about 7 mm to about 8 mm in diameter. For example, in one example embodiment, the e-vaping device may be about 84 mm long and may have a diameter of about 7.8 mm.

As shown in FIGS. 1-7, in at least one example embodiment, the first section 70 may include the mouth-end insert 8 including eight outlets 24. The outlets 24 may be located off-axis from the longitudinal axis of the e-vaping device 60. The outlets 24 may be angled outwardly in relation to the longitudinal axis of the e-vaping device 60. The outlets 24 may be substantially uniformly distributed about the perimeter of the mouth-end insert 8 so as to substantially uniformly distribute vapor and create a greater perception of fullness. As shown in FIGS. 3-6, the outlets 24 may include a first set of outlets 100 and a second set of outlets 102. Thus, as the vapor passes through the outlets 100, 102, the vapor may move in different directions. In contrast, e-vaping devices having a single, on-axis orifice tend to direct vapor as a single jet of greater velocity toward a more limited location.

In an example embodiment, the outlets 24 may be angled at about 5° to about 60° with respect to the longitudinal axis of the outer housing 6 so as to more completely distribute vapor and remove droplets. In yet another example embodiment, the outlets 24 may be angled at an angle of about 40° to about 50° with respect to the longitudinal axis of the outer housing 6 or about 40° to about 45°. In an example embodiment, the outlets 24 may be angled at an angle of about 42° with respect to the longitudinal axis of the outer housing 6.

In an example embodiment, the first set 100 of four outlets may be larger than the second set 102 of four outlets. In some example embodiments, each of the four outlets in the first set 100 may be at least twice the size of each of the outlets in the second set 102. Each of the outlets 24 of the first set 100 may have a length ranging from about 1.0 mm to about 3.0 mm and a width at a widest point ranging from about 1.0 mm to about 2.0 mm. Each of the outlets 24 of the second set 102 may have a length ranging from about 0.5 mm to about 1.5 mm and a width at a widest point ranging from about 0.5 mm to about 1.0 mm.

The outlets 24 may have a tear-drop cross-section. In other example embodiments, the outlets 24 may have a generally triangular cross-section or a generally polygonal cross-section, such as pentagonal. In some example embodiments, the outlets 24 may have a generally circular cross-section.

In an example embodiment, the mouth-end insert 8 has a generally disc-shaped, transverse wall 104 in which the outlets 100, 102 are formed. The transverse wall 104 has a generally cylindrical side wall 106 extending upstream therefrom. In at least one example embodiment, a diameter of the transverse wall 104 is about the same as an outer diameter of the housing 6. In some example embodiments, the diameter of the transverse wall 104 is larger than a circumference of the side wall. The side wall 106 may have a beveled upstream edge 108 that is configured to facilitate insertion of the mouth-end insert 8 in the housing 6. In some example embodiments, the sidewall may have a length ranging from about 3 mm to about 5 mm.

The mouth-end insert 8 may be held in place in the housing 6 by friction fit. In some example embodiments, the mouth-end insert 8 may be held in place in the housing 6 by use of an adhesive.

In at least one example embodiment, the diameter of the transverse wall 104 ranges from about 9.0 mm to about 9.5 mm. In some example embodiments, the diameter of the transverse wall is about 9.3 mm.

In an example embodiment, the outlets 24 have an outlet area ranging from about 12 $mm^2$ to about 14 $mm^2$. In some example embodiments, the outlet area may be about 13.2 $mm^2$.

The mouth-end insert 8 may have an internal volume ranging from about 105 $mm^3$ to about 112 $mm^3$. In some example embodiments, the internal volume may be about 108.4 $mm^3$.

In an example embodiment, each of the outlets 24 may have dimensions and/or diameters ranging from about 0.015 inch to about 0.090 inch (e.g., about 0.020 inch to about 0.040 inch or about 0.028 inch to about 0.038 inch). The size of the diverging outlets 24 and the number of diverging outlets 24 may be selected to adjust the resistance-to-draw (RTD) of the e-vaping device 60, if desired.

In at least one example embodiment, the mouth-end insert 8 has an inner surface 181. After formation, some vapor may condense into liquid form before exiting the e-vaping device 60. Any condensed liquid may deposit on and/or strike the inner surface 181. If the liquid strikes the inner surface 181, the liquid may break into smaller droplets.

In at least one example embodiment, an average exit velocity of the vapor as it exits the e-vaping device 60 via the outlets 24 is about 1.0 m/s to about 1.2 m/s. In some example embodiment, a maximum exit velocity as it exits the e-vaping device 60 ranges from about 2.0 m/s to about 2.2 m/s.

In at least one example embodiment, the mouth-end insert 8 is formed of high density polyethylene. In other example embodiments, the mouth-end insert 8 may be formed of other heat resistant materials, including other plastics and metal.

In at least one example embodiment, a ratio of the combined outlet area to an area of the mouth-end insert ranges from about 1:3 to about 1:6. In other example embodiments, the ratio of the combined outlet area to an area of the mouth-end insert ranges from about 1:4 to about 1:5.

The mouth-end insert 8 including eight angled outlets 24 and an outlet area of 13.2 $mm^2$ was compared to (1) a mouth-end insert having a single, centrally located outlet having a diameter of about 8.8 mm and an outlet area of about 4.9 $mm^2$ and (2) a mouth-end insert including four angled outlets with an outlet area of 16.6 $mm^2$. The cartridge and battery sections of the e-vaping device used for testing were identical. The resulting velocity and temperature measurements were found.

TABLE 1

| Results at 2 seconds | Mouth-end insert with single outlet | Mouth-end insert with four outlets | Mouth-end insert with eight outlets |
|---|---|---|---|
| Average Exit Velocity (m/s) | 1.6 | 1.0 | 1.1 |
| Maximum Exit Velocity (m/s) | 3.0 | 1.9 | 2.1 |
| Average Exit Temperature (° C.) | 88.4 | 79.9 | 64.8 |
| Maximum Exit Temperature (° C.) | 106.0 | 98.9 | 90.2 |
| Mouth-end insert Side Average Temperature (° C.) | 26.4 | 28.0 | 27.9 |

As shown in Table 1, the mouth-end insert 8 including eight outlets provides a vapor having a significantly lower average exit temperature as compared to mouth-end inserts having a single, central outlet or four angled outlets.

In at least one example embodiment, the mouth-end insert is configured to reduce a temperature of the vapor exiting the mouth-end insert via the outlets to a temperature ranging from about 60° C. to about 70° C.

While not wishing to be bound by theory, it is believed that the reduced temperature is caused by an increase in the surface area surrounding and between the eight outlets. The closed surface area is believed to absorb heat so as to provide a vapor with a lower average exit temperature.

While a number of example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

We claim:

1. A cartridge of an electronic vaping device, the cartridge comprising:

a mouth-end insert comprising, at least eight outlets configured to distribute vapor, at least one of the outlets being generally tear drop in shape, such that a portion of the at least one of the outlets is generally pointed, the generally pointed portion of the at least one of the outlets pointing towards a center of the mouth-end insert, the mouth-end insert having a surface area surrounding the outlets that is configured to absorb heat from the vapor and reduce a temperature of the vapor exiting the mouth-end insert via the outlets to an average exit temperature ranging from about 60° C. to about 70° C.

2. The cartridge of claim 1, wherein the average exit temperature of the vapor exiting the outlets ranges from about 62° C. to about 66° C.

3. The cartridge of claim 1, wherein at least one of the outlets is angled at about 5° to about 60° in relation to a longitudinal axis of the cartridge.

4. The cartridge of claim 1, wherein at least one of the outlets is angled at about 40° to about 50° in relation to a longitudinal axis of the cartridge.

5. The cartridge of claim 1, further comprising, an outer housing extending in a longitudinal direction, the mouth-end insert affixed within an end of the outer housing;

an inner tube within the outer housing;

a reservoir containing a pre-vapor formulation, the reservoir contained in an outer annulus between the outer housing and the inner tube;

a heater in the inner tube; and a wick in fluid communication with the pre-vapor formulation and the heater, such that the wick delivers the pre-vapor formulation to the heater.

6. The cartridge of claim 1, wherein each of the outlets has a width ranging from about 0.015 inch to about 0.090 inch.

7. The cartridge of claim 1, wherein four of the outlets are larger than a remaining four outlets.

8. The cartridge of claim 1, wherein the eight outlets have a combined outlet area of about 12 $mm^2$ to about 14 $mm^2$.

9. The cartridge of claim 1, wherein a ratio of a combined outlet area of the outlets to an area of the mouth-end insert ranges from about 1:3 to about 1:6.

10. The cartridge of claim 1, wherein the ratio of the combined outlet area of the outlets to an area of the mouth-end insert ranges from about 1:4 to about 1:5.

11. The cartridge of claim 1, wherein the mouth-end insert has a generally cylindrical sidewall and a round downstream surface.

12. The cartridge of claim 11, wherein the downstream surface of the mouth-end insert has a diameter ranging from about 8.5 mm to about 10.0 mm.

13. The cartridge of claim 12, wherein the diameter of the downstream surface of the mouth-end insert ranges from about 9.0 mm to about 9.5 mm.

14. The cartridge of claim 11, wherein the downstream surface of the mouth-end insert has a beveled edge.

15. The cartridge of claim 12, wherein a circumference of the sidewall is less than the diameter of the downstream surface of the mouth-end insert.

16. The cartridge of claim 11, wherein the sidewall has a length ranging from about 3 mm to about 5 mm.

17. The cartridge of claim 11, wherein the sidewall has a beveled, upstream edge.

18. The cartridge of claim 1, wherein the outlets are configured to produce an average exit velocity ranging from about 1.0 m/s to about 1.2 m/s.

19. The cartridge of claim 1, wherein the outlets are configured to produce a maximum exit velocity ranging from about 2.0 m/s to about 2.2 m/s.

20. The cartridge of claim 1, wherein the mouth-end insert is formed of high density polyethylene.

21. A cartridge of an electronic vaping device, the cartridge comprising:

a mouth-end insert comprising, eight outlets configured to distribute vapor, at least one of the outlets being generally tear drop in shape, such that a portion of the at least one of the outlets is generally pointed, the generally pointed portion of the at least one of the outlets pointing towards a center of the mouth-end insert, the eight outlets having a combined outlet area of about 12 $mm^2$ to about 14 $mm^2$, such that a ratio of the combined outlet area to an area of the mouth-end insert ranges from about 1:3 to about 1:6.

22. The cartridge of claim 1, wherein the eight outlets are generally tear drop in shape, such that at least one portion of each of the outlets is generally pointed.

23. The cartridge of claim 1, wherein at least one of the outlets widens in a longitudinal direction of the cartridge extending from a mouth-end of the cartridge.

* * * * *